United States Patent [19]

Levey

[11] 4,388,016

[45] Jun. 14, 1983

[54] EXPANSION JOINT AND SEAL FOR USE IN CONCRETE STRUCTURES

[75] Inventor: Bertram J. Levey, Covington, La.

[73] Assignee: Construction Materials, Inc., Baton Rouge, La.

[21] Appl. No.: 269,619

[22] Filed: Jun. 2, 1981

[51] Int. Cl.[3] ..... E01C 11/04

[52] U.S. Cl. ..... 404/48; 52/396

[58] Field of Search ..... 404/48, 47, 65, 68, 404/69; 52/396

[56] References Cited

U.S. PATENT DOCUMENTS

| | | | |
|---|---|---|---|
| 2,246,903 | 6/1941 | Spears | 404/48 |
| 3,276,335 | 10/1966 | Middlestadt | 404/48 |
| 3,418,898 | 12/1968 | Cimini | 404/48 |
| 3,782,846 | 1/1974 | Johnson | 404/48 |
| 3,824,025 | 7/1974 | Beutler | 404/48 |
| 3,967,911 | 7/1976 | Miers | 404/48 |
| 4,008,974 | 2/1977 | Miers | 404/48 |
| 4,050,206 | 9/1977 | Utsuyama | 404/48 X |
| 4,090,800 | 5/1978 | Koch | 404/48 |

*Primary Examiner*—Nile C. Byers, Jr.

*Attorney, Agent, or Firm*—Llewellyn A. Proctor

[57] ABSTRACT

This invention relates to a novel, and improved expansion joint and seal for use in sealing concrete expansion joints. In general the device is constituted of an elongate flexible seal member inclusive of an expandable loop portion from the non-closed sides of which a pair of alternately disposed downwardly projected leg portions are extended. The device also includes a pair of elongate side frames, each of which is attached to an alternately disposed downwardly projected leg portion of said elongate flexible seal member, and a removable, elongate top cap for affixing upon the loop portion of said elongate flexible seal member. The improvement relates to, inter alia, in said member, side frames which contain one or more pairs of inwardly sloped laterally aligned ribs which form longitudinal channels with relatively wide bottom surfaces with restricted surface outlets, the channel forming a means of tenaciously bonding plastic cement to said side frames to form a flexible seal. The side frames also include upwardly faced deep U-shaped slots within which each of the leg portions of said expandable loop portion of the elongate flexible seal is extended, and bonded by use of adhesive.

7 Claims, 4 Drawing Figures

EXPANSION JOINT AND SEAL FOR USE IN CONCRETE STRUCTURES

Concrete occupies a dominant position in both major and minor constructions. It is used, e.g., in the construction of virtually all large buildings, sidewalks, dams, bridges, harbors, airport runways and highways. In the monolithic concrete slabs constituting such structural units, as is known, there are appreciable movements due to thermal contractions and expansions and consequently it is necessary, and commonplace, to provide expansion joints between adjacent concrete slabs to allow for these movements to prevent damage to structural units.

Expansion joints between adjacent concrete slabs allows space for expansion, and contraction, of the concrete slabs. The most simple expansion joint is a space left between adjacent concrete slabs which permits expansion of the slabs into the space, and subsequent contraction. This type of expansion joint, however, leaves a void between slabs within which water, ice, or dirt and other incompressible materials can collect this in itself ultimately resulting in damage to the structure. Consequently, various types of expansion joints and seals have been developed which keep out water, ice, dirt and other types of debris while yet allowing a space for the necessary expansion, and contractions, of such slabs.

One of the most advanced, and useful expansion joint and seal devices for such purpose is disclosed in U.S. Pat. No. 3,782,846 which issued on Jan. 1, 1974. In this patent there is described an expansion joint and seal device constituted of three parts, a flexible seal which includes an upper expandable loop portion, generally constituted of rubber or plastic, from which is extended two vertically oriented, parallelly aligned legs, or end portions, and a top cap, also generally constituted of rubber or plastic, which fits over the loop portion of the device. The outer surfaces of the two legs, or end portions, are covered with particles of aggregate. In use, the device with the loop upward and covered by the top cap is vertically inserted into the upper surface of freshly poured concrete, the top surface of the cap after insertion flushing substantially with the surface of the poured concrete. After setting the top cap can be removed. The particles of aggregate grip the freshly poured concrete, and after curing the concrete contracts, breaks and separates below the inserted expansion joint and seal device, thus forming two adjacent concrete slabs both subject to normal thermal contractions and expansions over its life. The expansion joint, or opening between the two slabs however is sealed by said expansion joint and seal in that each of the two legs is adjoined to the adjacent slabs, the expansable loop portion adjoined to each leg forming a top cover, or seal, which prevents entry of water, ice, dirt or other debris into the joint, while yet allowing normal expansions and contractions of the two concrete slabs.

While the expansion joint and seal device of U.S. Pat. No. 3,782,846 has overcome many of the complexities and problems associated with prior art expansion joints and seals, and performs admirably in service, it nonetheless is somewhat difficult to manufacture and the seal formed between the aggregate particles and the cured concrete leaves something to be desired.

Accordingly, it is a primary object of this invention to obviate these and other prior art difficulties.

In particular, it is an object to provide a novel, improved expandable joint and seal assembly, or device, which is relatively simple and more easily fabricated, and forms a tight, permanent grip on the cured concrete.

These and other object are achieved in accordance with the present invention, a novel expansion joint and seal comprising in combination: (1) an elongate flexible seal member inclusive of an expandable loop portion from the non-closed sides of which a pair of alternately disposed downwardly projected leg portions are extended, (2) a pair of extension members, or side frames, for attachment to each of said alternately disposed downwardly projected leg portions or said loop, the outer surfaces of each of which is provided with one or more pairs of inwardly sloped laterally aligned ribs or panels which form longitudinal channels with relatively wide bottom surfaces with restricted surface outlets and (3) a removable, elongate top cap for affixing upon the loop portion of said elongate flexible seal member.

In use, the novel expansion joint and seal is pressed vertically downwardly into a block of freshly poured, plastic concrete until the upper surface of the cap flushes with the plastic concrete. The elongate top cap (3), supra, is subsequently removed.

The longitudinal channels formed in the side frames or extension members (2), supra, are filled with the plastic concrete and, on setting and curing in effect bonds said side frames, or extension members, with the concrete. When the concrete block is cured sufficiently, the block of concrete cracks or breaks below the partitioning expansion joint and seal to form two adjacent concrete slabs each of which are subject to thermal expansions and contractions. Each of the legs or the expandable loop portion of the elongate flexible seal member (1), supra, and side frames, or extension members adjoined thereto (2), supra, are attached to an adjacent block and, with the loop portion of said flexible seal member (1), supra, closes the expansion joint and prevents entry of water, ice, dirt and other incompressable materials which would damage the structure.

The invention, and its principle of operation, will be more fully understood by reference to the following detailed description of a specific, and preferred embodiment, and to the attached drawings to which reference is made in the description. In the drawings, similar numbers are used to represent similar parts or components. Subscripts are used with numbers to represent subcomponents.

Figure 1:
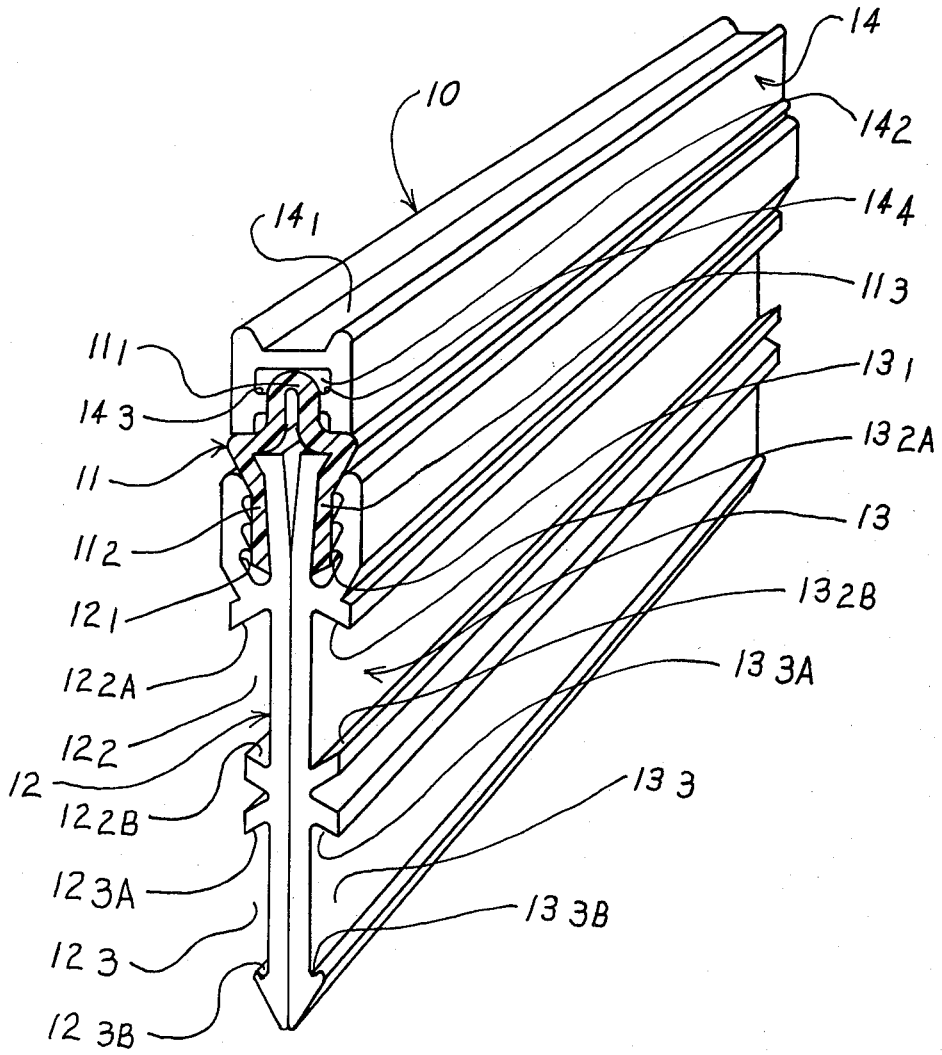
FIG. 1 is a perspective, side elevation view of a novel expansion joint and seal inclusive of (1) an expandable loop portion, (2) side frames, or extension members, and (3) a removable cap, supra.

Referring first to FIG. 1, there is shown a novel elongate flexable expansion joint and seal 10 comprised of an elongate flexible seal member 11, inclusive of an expanable loop portion $\mathbf{11}_1$, and pair of generally similar alternately disposed downwardly projecting legs $\mathbf{11}_2$, $\mathbf{11}_3$, with an adjoining pair of side frames, or extension members 12, 13. The loop portion 11, of the expansion joint and seal 10 is provided with an elongate removable top cap 14.

The elongate seal member 11 is perferably constituted of a unitary section of material, usually plastic, rubber or other elastomer preferably rubber; suitably an elastomer such as a neoprene. The loop portion $\mathbf{11}_1$, runs the entire length of the elongate seal member 11, the upper or top portion thereof being closed to provide a sealing feature. The elongate seal 11 at about its mid cross-section is tilted outwardly, then sloped inwardly, then downwardly to provide a means for attachment to the side frames, or extension members 12, 13.

The side frames, or extension members 12, 13 can be extruded from a unitary member, and the extruded member then cut into segments of similar lengths to provide said side frames, or extension members. The members 12, 13 are usually constituted of a rigid or hard plastic, hard rubber or the like. Preferably, the members are formed of an extrudable plastic or rubber. Polyvinyl chloride is a preferred material. The inner faces of these members 12, 13 are smooth; the outer faces, which provide a key and novel feature of this invention, are provided with one or more pairs of laterally aligned, inwardly sloped ribs or panels $\mathbf{12}_{2a}$, $\mathbf{12}_{2b}$, $\mathbf{12}_{3a}$, $\mathbf{12}_{3b}$, $\mathbf{13}_{2a}$, $\mathbf{13}_{2b}$, $\mathbf{13}_{3a}$, $\mathbf{13}_{3b}$ which forms longitudinal channels $\mathbf{12}_2$, $\mathbf{12}_3$, $\mathbf{13}_2$, $\mathbf{13}_3$ with relatively wide inner, or bottom surfaces, and relatively narrow outer surface outlets into which plastic concrete is extruded, and contained when the novel joint and seal is installed in a block of freshly poured, plastic concrete.

The concrete within the channels $\mathbf{12}_2$, $\mathbf{12}_3$, $\mathbf{13}_2$, $\mathbf{13}_3$ adheres tightly, and tenaceously to the side frames, or extension members 12, 13; and continues to adhere to the concrete after the concrete block cracks and forms two adjacent concrete structures. The lowermost ends of each of the side frame, or extension members 12, 13 are sloped inwardly and downwardly from the outer edges of the ribs, or panels $\mathbf{12}_{3b}$, $\mathbf{13}_{3b}$ to form a relatively sharp edge to facilitate insertion of the device into the plastic concrete, and form a water stop. The deep U-shaped channel portions $\mathbf{12}_1$, $\mathbf{13}_1$, located at the upper edges of the side frames, or extension members 12, 13, provide a means for attachment to the elongate flexible seal 11.

The deep U-shape of channels $\mathbf{12}_1$, $\mathbf{13}_1$ of extension members 12, 13 provide a large surface area for bonding the extending legs $\mathbf{11}_2$, $\mathbf{11}_3$ of elongate flexible seal 11 therein; twice the area as an ordinary lap seal. Moreover, the outer faces, or surface within the channels $\mathbf{12}_1$, $\mathbf{13}_1$ of extension 12, 13 are ribbed to further increase the surface area, and to provide an adequate amount of bonding agent for assurance in the formation of a tight bond. By virtue of the U-shaped, ridged surfaces of channels $\mathbf{12}_1$, $\mathbf{13}_1$ extending legs $\mathbf{11}_2$, $\mathbf{11}_3$ can be tightly secured within channel portions $\mathbf{12}_1$, $\mathbf{13}_1$ of the side frames, or extension members $\mathbf{12}_1$, 13. Suitably, the legs $\mathbf{11}_2$, $\mathbf{11}_3$ are pushed into the channels $\mathbf{12}_1$, $\mathbf{13}_1$ and bonded therein by the use of an elastomeric adhesive; preferably, they are epoxied into the channels $\mathbf{12}_1$, $\mathbf{13}_1$ of the side frames, or extension members 12, 13.

The removable top cap 14 is an elongate channel shaped member of length equal to that of the elongate flexible seal 11. A shallow channel $\mathbf{14}_1$, runs along the upper side of top cap 14, and a deep channel $\mathbf{14}_2$ along the underside. The deep channel $\mathbf{14}_2$ is provided with a pair elongate, alternately disposed projecting ribs $\mathbf{14}_3$, $\mathbf{14}_4$ which, when the top cap 14 is fitted over the loop portion $\mathbf{11}_1$ of elongate flexible seal 11 grips said latter member sufficient that it cannot be accidentally dislodged until its removal is desired. The top cap 14 is constituted of a rigid or hard plastic or rubber, preferably a plastic such as polyvinyl chloride.

Figure 2:
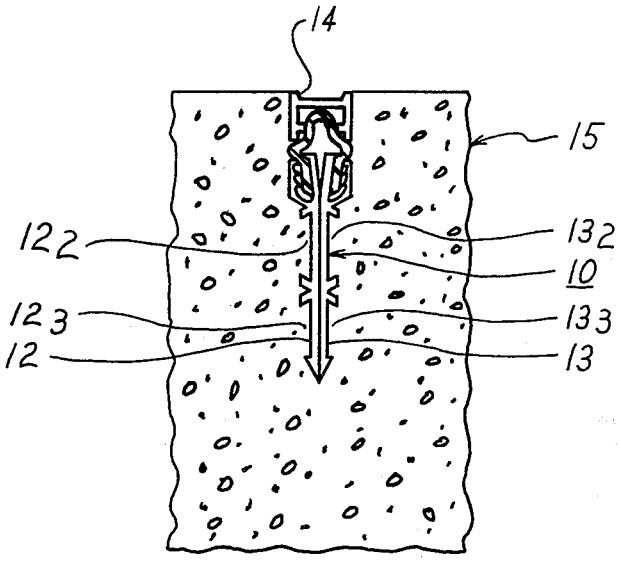
FIG. 2 is a schematic view of the expansion joint and seal installed in place in a block of plastic concrete, the upper surface of the removable cap being substantially flush with the surface of the concrete.

In use, the expansion joint and seal 10 is installed in a freshly poured plastic concrete block 15 as shown by reference to FIG. 2. The device 10, with removable cap 14 in place, is installed vertically, or perpendicularly to and flush with the surface of the concrete. In particular, the removable cap 14, with the upper surface flush with the surface of the concrete, assures proper installation of the loop portion 11, or the elongate flexible seal member 11 below the top of the finished pavement. Concrete is consolidated along both sides of the device 10 by jiggling or vibrating the plastic concrete mass. This facilitates flow of plastic concrete into the channels $\mathbf{12}_2$, $\mathbf{12}_3$, $\mathbf{13}_2$, $\mathbf{13}_3$ of the side frames, or extension members 12, 13.

Figure 3:
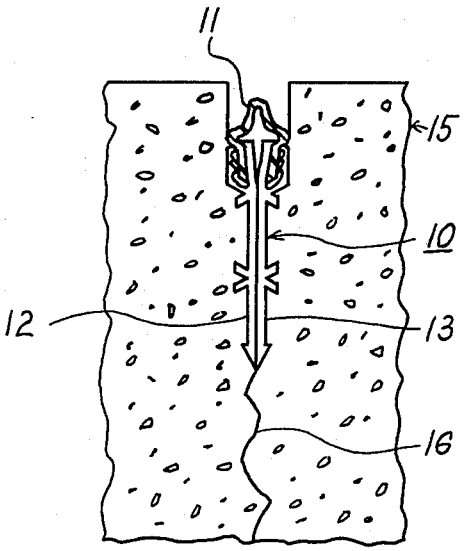
FIG. 3 is a schematic view of the installed expansion joint and seal after removal of the cap, the concrete having begun to set.

Referring to FIG. 3, the top cap 14 is now removed from the elongate expansion joint and seal device 10, this being generally from about 1 day to about 15 days following installation. The top loop 11, it will be observed lies just below the surface of the concrete block 15. A crack 16 begins to form below the device 10 as the concrete sets.

Figure 4:
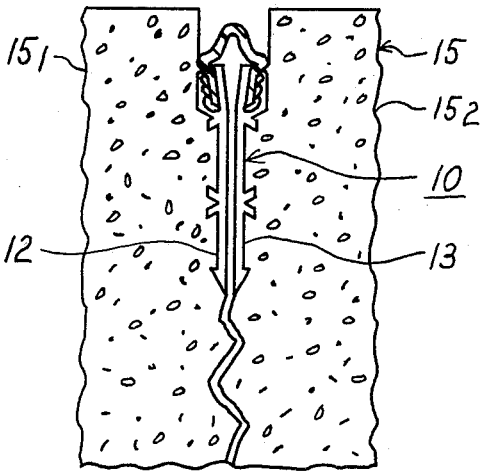
FIG. 4 is a schematic view of the installed expansion joint and seal showing its use in controlling the expansion joint formed between the two adjacent blocks of concrete which are formed to suppress further cracking by sealing said joint against infiltration by water and incompressables.

With reference to FIG. 4, the crack 16 has widened, two adjacent concrete blocks $\mathbf{15}_1$, $\mathbf{15}_2$ being formed from the setting concrete. The side frames, on extension members 12, 13 are now tightly adhered to each face of adjacent blocks $\mathbf{15}_1$, $\mathbf{15}_2$ each moving with the respective block $\mathbf{15}_1$, $\mathbf{15}_2$ as it contracts or expands. The loop member 11 permanently covers, and permanently seals the expansion joint between blocks $\mathbf{15}_1$, $\mathbf{15}_2$ against incompressables and water.

Various modifications can be made in the expansion joint and seal without departing the spirit and scope of the invention.

Having described the invention, what is claimed is:

1. In apparatus constituting an expansion joint and seal device for use in sealing expansion joints in concrete constructions where, when plastic concrete block within which the device is installed and the concrete cured sufficiently the block cracks and is laterally separated to form an expansion joint between two adjacent concrete blocks each subject to thermal expansions and contractions, there is included an elongate flexible seal member inclusive of an expandable upwardly faced closed loop portion, a removable elongate top cap for affixing upon the loop portion of said elongate flexible seal member for covering same, and a pair of alternately disposed downwardly projecting leg portions extending from the non-closed sides of said loop portion, the improvement comprising a pair of elongate side frames, each of which includes upwardly faced deep U-shaped slots within which each of the leg portions of said expandable loop portion of the elongate flexible seal is extended, bonded, and attached by use of an adhesive, each of which contains on an outer surface, one or more pairs of inwardly sloped laterally aligned ribs which form longitudinal channels with relatively wide bottom surfaces with restricted surface outlets, which forms a means of tenaciously bonding plastic cement to said side frames to form a flexible seal, and each of the side frames are formed from a unitary extruded extrudate mass of rigid plastic, or rubber, by severing side frames of equal length from said extrudate mass.

2. The apparatus of claim 1 wherein an inner surface of each of the upwardly faced deep U-shaped slots of the side frames is ribbed to aid in bonding said legs of the non-closed side of the loop portion of the elongate flexible seal member therein via use of an adhesive.

3. The apparatus of claim 2 wherein the outwardly faced inner surface of each of the deep U-shaped slots is ribbed.

4. The apparatus of claim 1 wherein each of the legs of said expandable loop portion of the elongate flexible seal is bonded within the deep U-shaped slots by use of an epoxy adhesive.

5. The apparatus of claim 1 wherein the inside faces of each of said side frames is flat, and the outer lowermost edges of each is tapered inwardly from the outer edge of the lowermost rib of each to provide a sharp edge to facilitate installation of the device in plastic concrete.

6. The apparatus of claim 1 wherein each of said side frames are constituted of rigid, extrudable plastic, or rubber.

7. The apparatus of claim 6 wherein the side frames are constituted of polyvinyl chloride plastic.

* * * * *